US006494127B1

(12) United States Patent
Cunningham

(10) Patent No.: US 6,494,127 B1
(45) Date of Patent: Dec. 17, 2002

(54) RADIAL PISTON ENGINE WITH GUIDE ROLLERS

(75) Inventor: Sinclair Cunningham, Fife (GB)

(73) Assignee: Mannesmann Rexroth AG, Lohr (DE)

( * ) Notice: Subject to any disclaimer, the term of this patent is extended or adjusted under 35 U.S.C. 154(b) by 0 days.

(21) Appl. No.: 09/623,842

(22) PCT Filed: Mar. 10, 1999

(86) PCT No.: PCT/EP99/01551

§ 371 (c)(1),
(2), (4) Date: Nov. 20, 2000

(87) PCT Pub. No.: WO99/46504

PCT Pub. Date: Sep. 16, 1999

(30) Foreign Application Priority Data

Mar. 10, 1998 (DE) ..... 198 10 372

(51) Int. Cl.[7] ..... F01B 13/06
(52) U.S. Cl. ..... 91/491; 91/498; 417/273
(58) Field of Search ..... 91/491, 498, 492; 92/72, 165 R, 165 PR, 58; 417/273, 462

(56) References Cited

U.S. PATENT DOCUMENTS

| | | | | |
|---|---|---|---|---|
| 3,922,956 A | | 12/1975 | Foster | |
| 3,978,771 A | * | 9/1976 | Burnight et al. | 91/491 |
| 4,704,948 A | | 11/1987 | Wüsthof et al. | |
| 4,719,843 A | | 1/1988 | Nöel | |
| 5,081,906 A | | 1/1992 | Lemaire et al. | |
| 5,632,191 A | | 5/1997 | Lemaire et al. | |

FOREIGN PATENT DOCUMENTS

| | | | |
|---|---|---|---|
| DE | 35 30 979 | | 3/1987 |
| DE | 44 21 535 | | 12/1995 |
| DE | 196 02 770 | | 7/1997 |
| DE | 196 18 792 | | 11/1997 |
| DE | 196 18 793 | | 11/1997 |
| DE | 198 10 372 | | 9/1999 |
| EP | 0 046 691 | | 3/1982 |
| EP | 0 524 437 | | 1/1993 |
| GB | 1 483 927 | | 8/1977 |
| GB | 2 238 086 | | 5/1991 |
| GB | 19851324 C | * | 3/2000 |

* cited by examiner

*Primary Examiner*—Teresa Walberg
*Assistant Examiner*—Quang Van
(74) *Attorney, Agent, or Firm*—Oblon, Spivak, McClelland, Maier & Neustadt, P.C.

(57) ABSTRACT

The invention concerns a technically optimized radial piston engine comprising a cam ring and a cylinder block arranged so as to rotate about an axis of rotation relative to the cam ring and having a plurality of cylinders oriented in the radial direction of the cylinder block. A piston capable of being radially displaced is located in each cylinder, resting on the cam ring via a roller. Said roller is mounted on the piston so as to rotate about an axis parallel to that of the cylinder block and rests axially, relative to its axis of rotation in the cylinder, against roller guides arranged on its surfaces. Said radial piston engine is characterized in that the roller guides are integrally mobile with the roller associated with them, in the piston stroke direction, and thereby driven by the roller both when the piston performs a loaded stroke and an idle stroke, without any contact occurring between the roller guides and the cam ring. The pistons are rotationally fixed by a torsional stop which is separate from the roller guide.

11 Claims, 5 Drawing Sheets

RADIAL PISTON ENGINE WITH GUIDE ROLLERS

BACKGROUND OF THE INVENTION

1. Field of the Invention

The present invention relates to a radial piston engine with roller guides for axial guidance of the rollers, via which the pistons are braced against the cam ring.

2. Discussion of the Background

From British Patent GB B 2238086 there is known a radial piston engine corresponding to the preamble of claim 1, wherein the object was to reduce the manufacturing complexity previously associated with axial positioning of the rollers and thus to lower the manufacturing and assembly costs. This object was supposedly achieved in that, in each of the spaces between the roller end faces and the cylindrical inside face as the roller guide, there is disposed a wedge piece, whose cross section viewed in piston displacement direction is a circular segment, and which positions the roller axially in the cylinder relative to the cam. ring. The wedge pieces disclosed in the cited patent can be divided substantially into three different designs.

In a first design, each wedge piece has on the side facing the roller a plane surface which bears on the end face of the roller and on the side facing away from the roller a cylindrical surface which is in contact with the inside face of the cylinder. In addition, this wedge piece is accommodated in the space between roller, piston and cylindrical inside face, without being rigidly connected to any of these components. By virtue of the fact that the wedge piece is freely movable in piston displacement direction relative to the roller, the piston urges the wedge pieces toward the cam ring during a load stroke. In the process, the wedge pieces do not yet come into contact with the cams formed on the cam ring. In the ensuing idle stroke of the piston, however, the wedge pieces strike the cams formed on the cam ring. This recurring striking contact between the cams and the wedge pieces as well as the friction occurring therebetween can lead to severe wear of the wedge pieces. A further disadvantage of this design is that the width of the cam ring must be at least sufficiently large that the cam ring in addition to the roller also provides a contact face for the two laterally disposed wedge pieces. Aside from large total weight of the radial piston engine, a broad cam ring results in high manufacturing costs due to the greater manufacturing complexity associated with precision machining of the cam ring.

In a second design, each of the two wedge pieces has on the side facing the roller a driver-like projection, which extends toward the other wedge piece in an opening provided in the piston between piston and roller. Since in this case the wedge pieces are driven back into the cylinder by the roller during an idle stroke of the piston, striking contact between the wedge pieces and the cams basically cannot occur. Due to the high relative velocity between the roller and the driver-like projections of the wedge pieces in contact with the outside circumference of the roller, however, severe abrasion can take place on the driver-like projections. With increasing abrasion of the driver-like projections, the space available for play of the wedge pieces in piston displacement direction could ultimately increase to the point that striking contact could occur between the wedge pieces and the cams. A further disadvantage of this design is that driver-like projections must be formed on the roller guides and recesses must be formed on the piston, thus increasing the manufacturing complexity and thus the manufacturing costs.

In addition, the friction between the roller and the wedge pieces in the two foregoing designs occurs over the entire end face of the roller. This relatively large-area frictional contact necessitates precision machining of the friction faces of both components, once again resulting in high manufacturing costs.

At that time a further assumption was that, by virtue of the recurring contact of the rollers with the cam ring, the rollers and thus the respective piston automatically assume a particular angular position in the cylinder or relative to the cam ring, which is critical for reliable operation of the radial piston engine. In certain cases, however, for example during initial operation of the radial piston engine, when hydraulic fluid is fed to the cylinders for the first time, it is conceivable that the pistons and thus the rollers may be inserted so far into the respective piston that contact between roller and curved path does not yet occur. To ensure the necessary angular position of the piston in the cylinder in those cases, one of the two wedge pieces has, in a third design, on the side facing the cylindrical inside face, an elongated slot, into which a bolt, clamp or the like extending through the cylinder wall engages and in this way prevents turning of the piston in the cylinder and thus of the roller relative to the cam ring. The presence of the slot leads to weakening of the wedge piece in question, however, and thus to shortening of the useful life of the wedge piece, which is subjected to severe stresses and strains during operation of the radial piston engine. In addition, sliding contact takes place between the wedge piece and the bolt or clamp, which appears disadvantageous as regards good roller guidance. Furthermore, such a structural feature means high manufacturing complexity.

BRIEF SUMMARY OF THE INVENTION

In view of the disadvantages encountered in conventional radial piston engines, the object of the present invention is therefore to provide an optimally engineered radial piston engine, which is characterized by greater manufacturing simplicity and at the same time functionally reliable operation.

This object is achieved by the inventive subject matter according to the features of claim 1, which is characterized in particular in that the roller guides disposed on the front sides of the rollers are rigidly connected to the respective roller with respect to sliding in piston displacement direction.

Since the respective roller urges the roller guides in piston displacement direction, in other words both during the load stroke and during the idle stroke, the roller guides can be dimensioned such that they do not project beyond the outside circumference of the respective roller, thus ensuring that striking contact does not take place between the roller guides and the cam ring. This ultimately leads to longer useful life of the roller guides and thus to functionally reliable operation of the radial piston engine on the whole. In addition, material economies are achieved in the manufacture of the roller guides.

If the roller guides do not come into contact with the cam ring, the width of the cam ring can be further reduced to a width which corresponds at most to the width of the rollers. In this way, not only is the total weight of the radial piston engine lessened, but also manufacturing complexity and thus the manufacturing costs are considerably reduced with regard to precision machining of the curved paths of the cam ring.

By suitable structural measures, such as by formation of a cylindrical projection on the roller guide, which projection is inserted in a corresponding recess on the front side of the roller, the relative velocities at the friction faces of roller and roller guides and thus the wear of the two components can also be reduced. Because of the reduced wear, the play developed between roller and roller guides is kept to a minimum, even after prolonged operating time. This contributes to functionally reliable and dependable operation of the radial piston engine on the whole.

Further advantageous features of the inventive radial piston engine are subject matter of the dependent claims.

The roller and roller guides can be rigidly connected with respect to sliding in displacement direction by simple manufacturing techniques. For example, the roller guides can be provided on the side facing the end face of the roller with a cylindrical projection, which is insertable into a central cylindrical recess formed on the end face of the roller. Likewise, it would naturally also be conceivable for the roller guides to be provided on the side facing the front side of the roller with a recess into which a projection formed on the front side of the roller is insertable. Of course, the opening and the projection engaged therewith could also have conical shape. If the diameter of the openings and projections are dimensioned such that they are small compared with the outside diameter of the roller, or in other words such that the projections and the openings are concentrated on a central region around the axis of rotation of the roller, and if the projections are engaged with the respective openings in such a way that play is present between the annular face of the roller around the opening and of the face around the projection of the roller guide, the circumferential velocities present at the outside circumference of the projection and at the inside circumferential wall of the opening during operation of the radial piston engine are reduced, as is therefore the relative velocity between roller and roller guides. Moreover, since no friction occurs at the two spaced-apart faces of roller and roller guide, reduction of frictional abrasion of both components is achieved.

The surfaces of the roller guides in contact with the cylindrical inside face preferably have cylindrical shape for simplicity, thus achieving optimal guidance of the piston-roller system in the cylinder. Since the roller is normally not subjected to compressive loads in axial direction, it would also be conceivable, however, to give the surface of the roller guide bearing on the cylindrical inside face rotationally symmetric shape or to construct it as a spherical segment relative to the axis of rotation of the roller. In this case, rigid connection between roller guide and roller would even be possible both in piston displacement direction and in the direction of rotation of the roller. This would have the advantage that, during operation of the radial piston engine, friction between roller and roller guides would no longer take place and the friction occurring between roller guide and cylindrical inside face would be considerably reduced.

Heretofore it has been assumed that the roller is constantly in contact with the curved paths of the cam ring, whereby the angular position of the piston in the cylinder and accordingly the orientation of the roller relative to the curved path is automatically predetermined. As already explained in the introduction, however, it is possible for the contact between roller and cam ring to be separated. In this case it is possible according to the present invention to prevent turning of the piston in the cylinder by means of an antirotation device disposed separately from the roller guide and thus to maintain a particular orientation of the roller relative to the cam ring.

For this purpose, the piston can be provided on the end portion facing away from the roller with a flattened part oriented perpendicular relative to the axis of rotation of the cylinder block, which flattened part bears on a corresponding contact face of the antirotation device, thus unambiguously predetermining the angular position of the piston in the cylinder and of the roller relative to the curved path. Another effective expedient has proved to be providing the cylinder with at least two cylinder portions of different inside diameters and the piston accordingly with at least two piston portions of different diameters matching the corresponding cylinder diameters. In this case, the antirotation device is provided in the cylinder portion with the smaller inside diameter and the flattened part is provided accordingly on the piston portion with the smaller diameter. By this expedient, on the one hand a large face for admission of pressure is retained on the piston and on the other hand only little material is removed from the piston in order to form the flattened part. The additional antirotation device creates better guidance of the piston in the cylinder compared with the conventional antirotation device mentioned in the introduction, since according to the present invention large-area sliding contact takes place between piston and antirotation device.

The antirotation device preferably has a cross section which, viewed in piston displacement direction, is a circular segment, with an arc corresponding to the cylindrical inside face and a chord corresponding to the flattened part.

Since the cylinder block in any case is normally provided with axial inlet ports, through which the hydraulic fluid enters the respective cylinder spaces, the manufacturing complexity with regard to fixing the antirotation device in the cylinder can be reduced in that the antirotation device is fixed in the cylinder by means of a pin, which is inserted through the inlet port into a blind hole in the cylinder block aligned with the inlet port.

BRIEF DESCRIPTION OF SEVERAL VIEWS OF THE DRAWINGS

Further features and advantageous embodiments of the present invention will become clear from the description hereinafter of preferred embodiments with reference to the drawing, wherein.

DETAILED DESCRIPTION OF THE INVENTION

Referring now to FIGS. 1 to 6 there will be described a preferred embodiment of the inventive radial piston engine.

Figure 1:
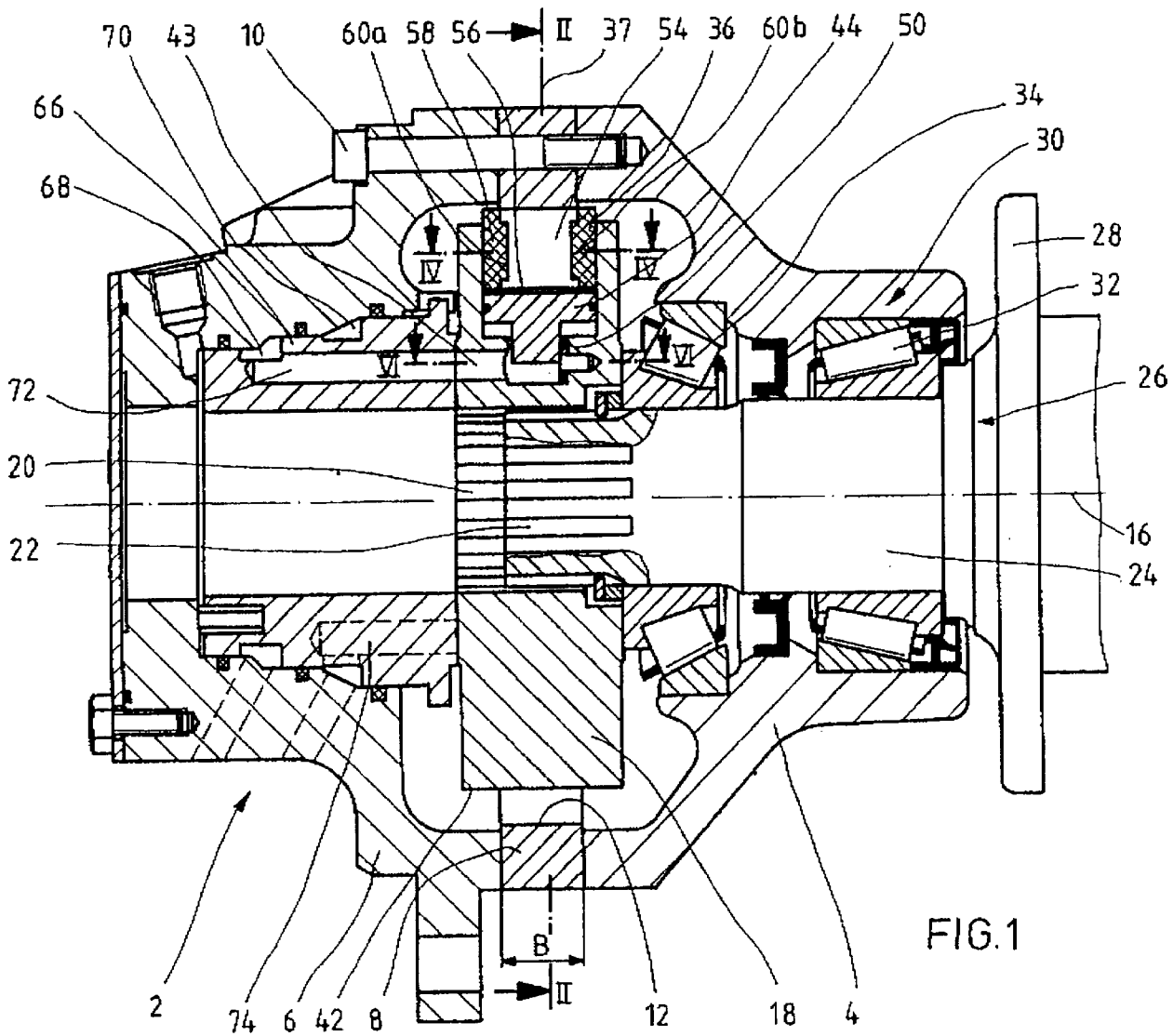
FIG. 1 shows a longitudinal section of a preferred embodiment of the inventive radial piston engine.
Figure 2:
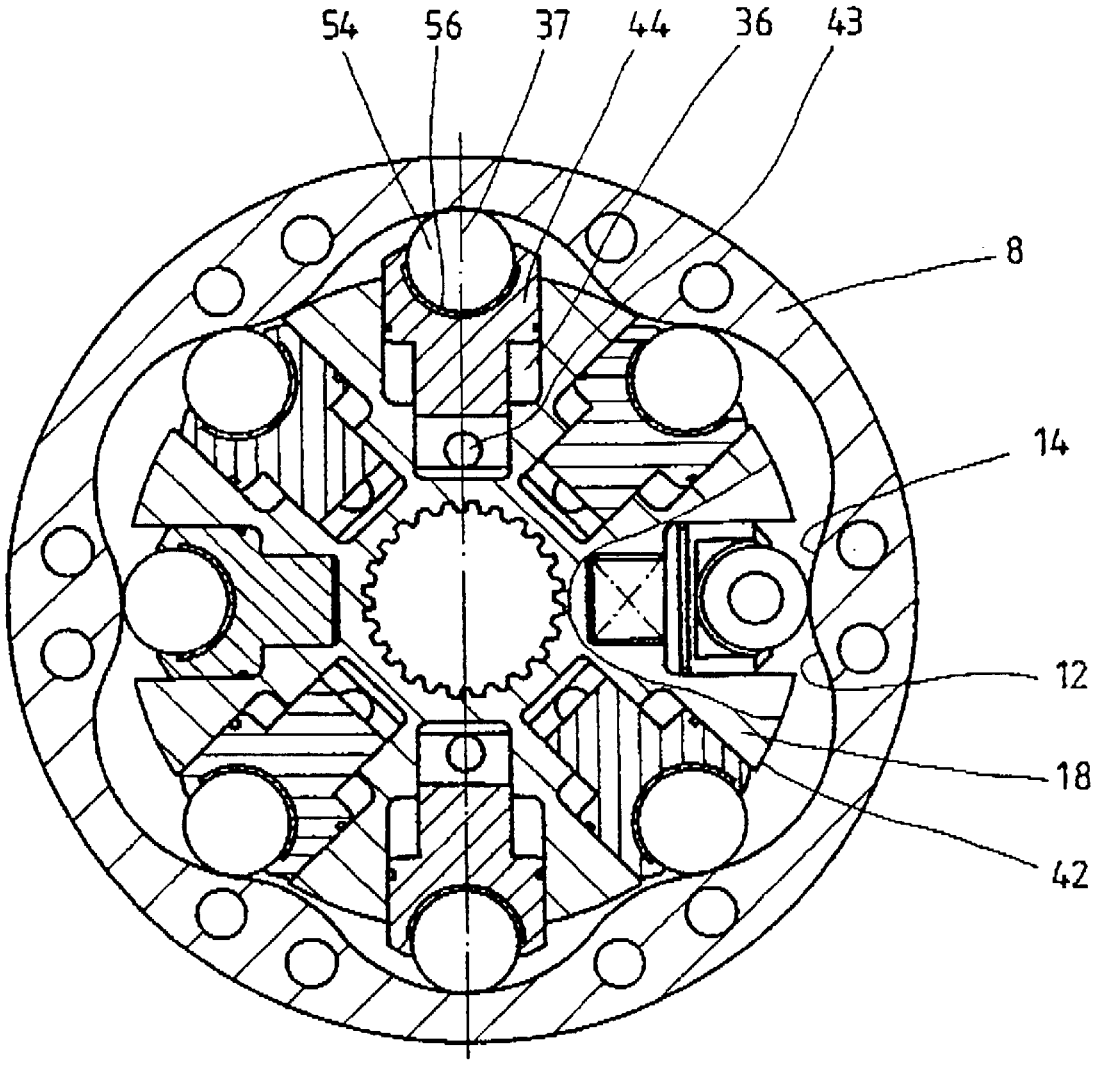
FIG. 2 shows a cross section through the cylinder block in FIG. 1 along line II—II.

Radial piston engine 2 comprises, as illustrated in FIG. 1, substantially two housing parts 4 and 6 as well as a cam ring 8 disposed between the two housing parts 4 and 6. The two housing parts 4 and 6 and cam ring 8 are coaxially connected to one another in fluid-tight manner by means of bolts 10. On the inside face of cam ring 8 there is formed a curved path 12 with a plurality of cams 14, as can be seen in particular in FIG. 2.

Inside cam ring 8 there is disposed a cylinder block 18 which can rotate around a longitudinal axis of rotation 16. As is evident in FIGS. 1 and 2, cylinder block 18 is provided with a central opening 20 having an internal toothing. In this opening 20 there is accommodated in axial sliding relationship an end portion 22 of a driven shaft 24, which is equipped with an external toothing corresponding to the internal toothing of opening 20. By means of a bearing assembly 30, driven shaft 24 is mounted to rotate relative to the two housing parts 4 and 6 and to cam ring 8. Bearing assembly 30 comprises two tapered roller bearings 32 and 34, which are mounted in housing part 4 and can transmit large axial and radial forces. The other end portion 26 of driven shaft 24 projects out of housing part 4 and is provided with a shaft flange 28 for fastening to a drive element (not shown) of a device to be driven, such as a gear of a loader.

In cylinder block 18 there is also formed a plurality of cylinders 36 directed radially outward in a star pattern relative to axis of rotation 16, which cylinders have cylinder axis 37 perpendicular relative to axis of rotation 16. As is evident in the enlarged illustration in FIG. 3*a*, cylinder 36 has a cylinder portion 38 of large inside diameter disposed radially outward relative to axis of rotation 16, as well as a cylinder portion 40 with small inside diameter disposed radially inward. Cylinder portion 38 is open at the substantially cylindrical outside circumferential face 42 of cylinder block 18. Furthermore, there is formed in cylinder block 18 an inlet port 43, which is parallel to longitudinal axis of rotation 16 and opens into cylinder portion 40, and via which hydraulic fluid is supplied and removed during operation of radial piston engine 2.

Figure 3A:
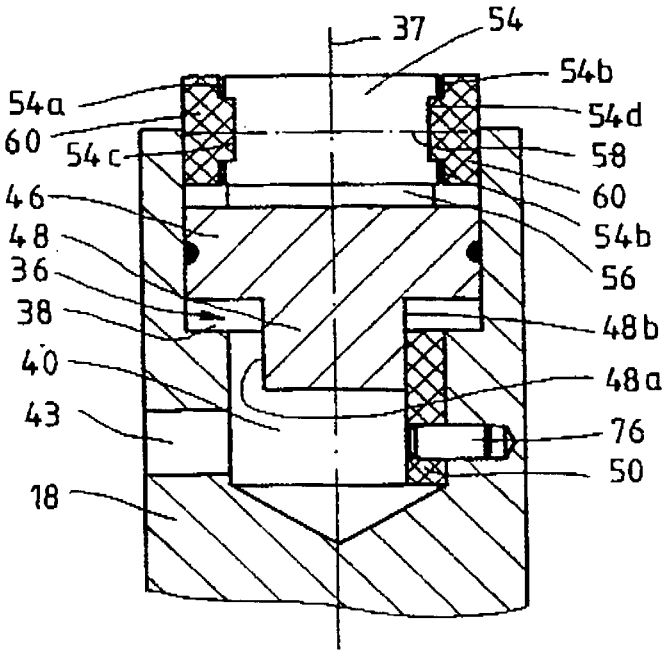
FIG. 3*a* shows a section on larger scale through the cylinder block in FIG. 2 along line III—III.
Figure 3B:
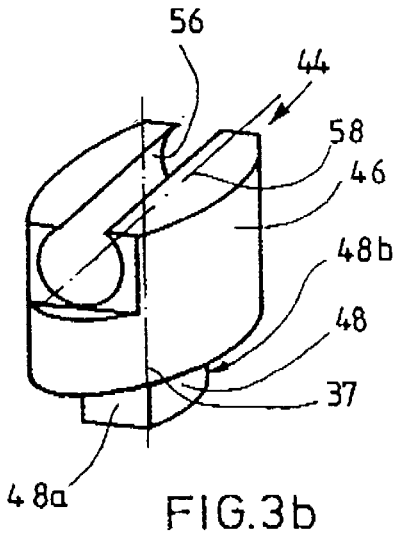
FIG. 3*b* shows a perspective view of the piston.
Figure 4:
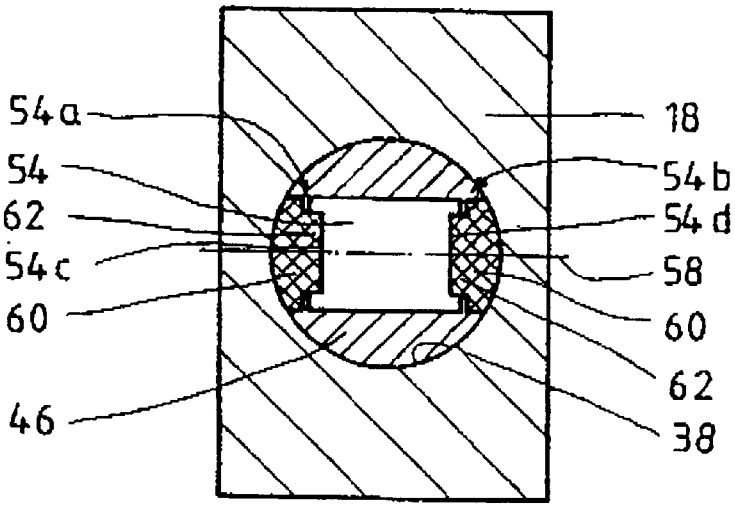
FIG. 4 shows a section through the cylinder block along line IV—IV in FIG. 1.
Figure 6:
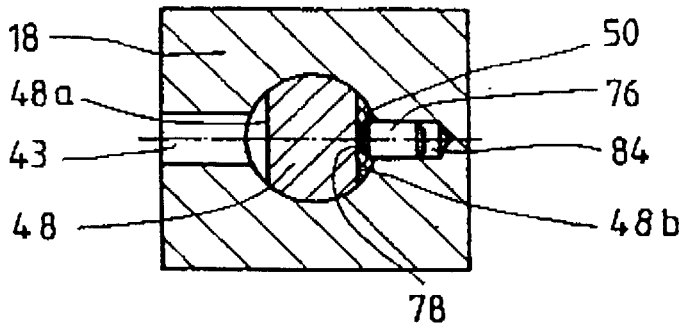
FIG. 6 shows a section through the cylinder block along line VI—VI in FIG. 1.

In cylinder 36 there is accommodated a piston 44 which, as shown in FIG. 3*b*, has piston portions 46 and 48. Piston portion 46 has a diameter corresponding substantially to the inside diameter of cylinder portion 38. Piston portion 48 has on its outside circumference two flattened parts 48*a* and 48*b* which, as is evident in FIG. 6, are oriented perpendicular to axis of rotation 16. The diameter of the outside circumference of piston portion 48 corresponds to the inside diameter of cylinder portion 40. Flattened part 48*b* defines a contact face, which bears on a correspondingly provided contact face 50*b* of an antirotation device 50, to be described in more detail hereinafter. Flattened portion 48*a* faces inlet port 43.

When cylinder 36 is supplied with hydraulic fluid via inlet ports 43 during operation of radial piston engine 2, pistons 44 are pressurized selectively to the effect that they execute a displacement movement toward cam ring 8. In the process they are each braced via a corresponding roller 54 against curved path 12 formed on cam ring 8. As shown in FIG. 1, axial width B of the cam ring in this embodiment of radial piston engine 2 corresponds substantially to the axial length of rollers 54. On the end portion of each piston portion 46 facing cam ring 8 there is formed a bearing 56, in which there is accommodated the respective roller 54, mounted to rotate relative to piston 44 around an axis of rotation 58.

Figure 5:
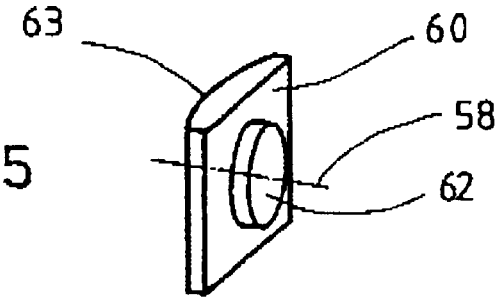
FIG. 5 shows a perspective view of the roller guide.

As shown in FIGS. 1, 3*a*, 4 and 5, a roller guide 60 is disposed at each of the two front sides 54*a* and 54*b* of roller 54, whereby the axial position of roller 54 in cylinder 36 and thus relative to piston 44 and curved path 12 is predetermined. Roller guides 60 are each disposed in a space formed between end faces 54*a* and 54*b* of roller 54, piston 44 and the cylindrical inside face of cylinder 36. FIG. 5 shows a perspective view of roller guide 60 which, viewed in piston displacement direction, has a cross section substantially in the form of a circular segment. On the chord side facing front side 54*a* or 54*b* of roller 54, each roller guide 60 has a cylindrical projection 62 which is axial relative to axis of rotation 58 and which is engaged with a corresponding central recess 54*c* or 54*d* on front sides 54*a* and 54*b* of roller 54. Cylindrical arc side 63 of each roller guide 60 bears on the cylindrical inside face of cylinder 36. The length of axial projection 62 is somewhat greater than the depth of recess 54*c* and 54*d*, and so play exists between the face of roller guide 60 around central projection 62 and each annular face on front sides 54*a* and 54*b* of roller 54 around central recess 54*c* and 54*d*.

By virtue of the type of connection of roller guides 60 with roller 54 described hereinabove, roller guides 60 are driven in piston displacement direction by respective roller 54 during operation of radial piston engine 2, or in other words during a displacement movement of the piston. Since, as described hereinabove, the width of the cam ring corresponds to the length of the rollers, striking contact between the roller guides and the cam ring does not occur during operation of the radial piston engine according to this embodiment, regardless of whether the roller guides project beyond the roller in piston displacement direction. In addition, the wear of both components due to the relative velocity that occurs between roller guides and roller during operation of the radial piston engine can be reduced considerably, since the friction between the two components occurs in a range in which the relative velocity is quite low.

Figure 7:
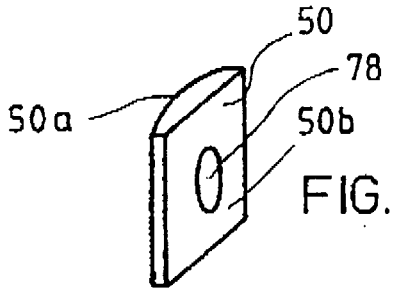
FIG. 7 shows a perspective view of the antirotation device.

As is evident in FIG. 6 and has already been mentioned hereinabove, there is provided at the cylindrical inside face of cylinder portion 40 opposite inlet port 52 a so-called antirotation device 50, which has the function of preventing turning of piston 44 in cylinder 38 around a cylinder axis 37. The critical factor here is that a particular angular position of piston 44 relative to cylinder axis 37 and thus of roller 54 relative to curved path 12 is maintained. Antirotation device 50 is fastened to cylinder block 18 by means of a pin 76, such as a tapered pin, straight pin or grooved pin in the manner shown in FIG. 3*a* or FIG. 6. FIG. 7 shows a perspective view of antirotation device 50 which, viewed in piston displacement direction, has in common with roller guide 60 a cross section in the form of a circular arc, wherein cylindrical arc side 50*a* bears on the cylindrical inside face of cylinder portion 40 and chord side 50*b* bears on flattened part 48*b* formed on piston portion 48 of piston 44. In contrast to roller guide 60, which in this embodiment of the radial piston engine is provided with a projection 62, there is formed in antirotation device 50 a cylindrical opening 78, in which there is seated the part of pin 76 which projects out of blind hole 84, disposed in cylinder block 18 in such a way as to be aligned with inlet port 43.

Reference symbol 66 denotes a fluid-control unit, by means of which, via inlet ports 43, hydraulic fluid is supplied to the respective cylinder spaces or removed from the respective cylinder spaces during operation of radial piston engine 2. Fluid-control unit 66 is disposed in fluid-tight relationship in housing part 6 such as to rotate therewith. In order to be able to distribute hydraulic fluid to the respective cylinder spaces, fluid-control unit 66 is provided with two separate circumferential grooves 68 and 70, which are in communication with fluid channels 72 and 74 respectively.

During operation of radial piston engine 2, fluid channels 72 and 74 come alternately into communication with axial inlet ports 43, which are formed in cylinder block 18 and each of which communicates with one of the cylinder spaces.

During operation of radial piston engine 2, pistons 44 are actuated by means of hydraulic fluid via fluid channels 68, 70, 72 and 74, inlet ports 43 and the cylinder spaces in such a way that they are urged radially outward relative to axis of rotation 16. In the process they are braced via the respective roller 54 against curved path 12 of cam ring 8, whereby cylinder block 18 is ultimately caused to perform a rotary movement around axis of rotation 16. The direction of rotation is selected by the mode of actuation. Because of the positive connection of driven shaft 24 to cylinder block 18, a torque is transmitted to driven shaft 24. This shaft is braced via tapered roller bearings 32 and 34 of bearing assembly 30. A drive element such as a gear of a loader (not illustrated in more detail here), which is connected via flange portion 28 to drive shaft 24, therefore receives a torque.

Figure 8A:
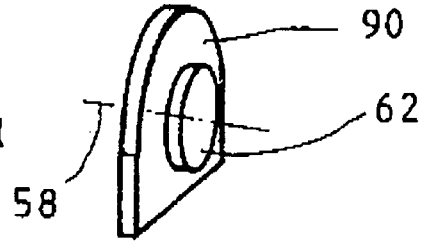
FIGS. 8*a* and 8*b* show modifications of the roller guide in FIG. 5.
Figure 8B:
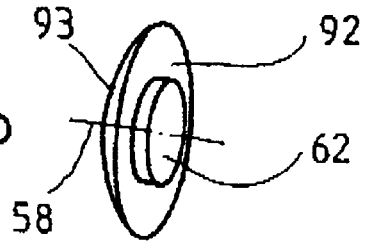

FIGS. 8*a* and 8*b* show modifications of the roller guides described in connection with the foregoing embodiment of the inventive radial piston engine.

Roller guide 90 illustrated in FIG. 8*a* differs from roller guide 60 shown in FIG. 5 in that, at the upper outside face facing cam ring 8, it is rounded in a manner corresponding to the outside circumference of roller 54 and is designed to ensure that it does not project beyond the outside circumference of the roller in piston displacement direction. Since roller guide 90 in this case does not project beyond the outside circumference of roller 54, and since in addition it is rigidly connected to roller 54 with respect to sliding in piston displacement direction, roller guide 90 could also be used—of course, only together with inventive roller 54—for a conventional radial piston engine with a cam ring, in which the cam ring has a width which is greater than the length of roller 54.

Whereas surfaces 63 of roller guides 60 in contact with the cylindrical inside face were of cylindrical structure hereinabove for the sake of simplicity, roller guide 92 shown in FIG. 8*b* is provided on the side facing the cylinder face with a surface 93 which is rotationally symmetric or has the form of a spherical segment relative to axis of rotation 58 of roller 54. Since the roller and thus also the roller guides normally do not experience particularly large axial loads during operation of the radial piston engine, the service life of the roller guides should not be shortened by giving the structure of the roller guides the form of a spherical segment. In order constantly to achieve reliable axial positioning of the rollers in this case, however, it is necessary that the extent to which the pistons are displaced during operation of the radial piston engine is sufficiently limited that axis of rotation 58 of each roller 54 is still disposed inside the cylinder even at maximum piston displacement. This restriction is not necessary in the roller guides mentioned hereinabove, however, because they are in contact over a large area.

In the special case shown in FIG. 8*b*, roller guides 92 could be connected positively and nonpositively to roller 54 not only in piston displacement direction but also in the direction of rotation of roller 54, so that friction no longer develops between roller and roller guide. Because of the small, substantially only linear contact of roller guide 92 on the cylindrical inside face, the friction occurring between roller guide 92 and cylindrical inside face would also be considerably reduced. Since roller guides 90 and roller 54 then can no longer turn relative to one another, the positive and/or nonpositive connection between roller guide and roller could also be achieved in any other manner. It would even be conceivable to construct the roller and the roller guides in one piece, or in other words to provide the roller guides on the roller.

Figure 9A:
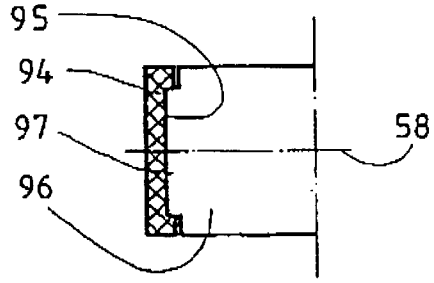
FIGS. 9*a* and 9*b* show modifications of the connection between roller guide and roller in FIG. 5.
Figure 9B:
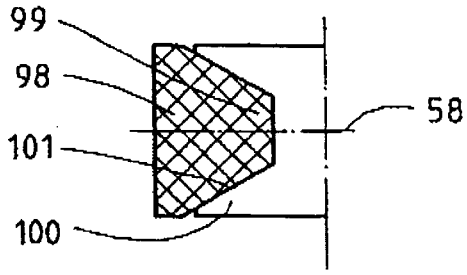

FIGS. 9*a* and 9*b* show further options for connecting the roller guides to the roller.

Whereas in the preferred practical example of inventive radial piston engine 2 described hereinabove there were formed on each roller guide a projection 62 and on the roller corresponding recesses 54*c* and 54*d*, roller guide 94 according to FIG. 9*a* is provided with a recess 95 and roller 96 with a corresponding projection 97. In this example also, play is present between the oppositely disposed faces on roller guide and roller around the recess or around the projection, whereby the friction developed between these components occurs in a range in which small relative velocities exist between roller and roller guides. However, the present invention is not limited merely to this arrangement; it would naturally also be conceivable for the roller guides to be directly in contact with the roller in the conventional sense, or in other words without play.

Roller guide 98 in FIG. 9*b* is characterized by a conical projection 99, which is engaged with a corresponding central recess 101 of conical shape on roller 100. In this case the roller guide is engaged with the roller without play but, as is also the case in the foregoing examples, the area of contact between roller 100 and roller guides 98 is relocated into a central region relative to axis of rotation 58.

Figure 10A:
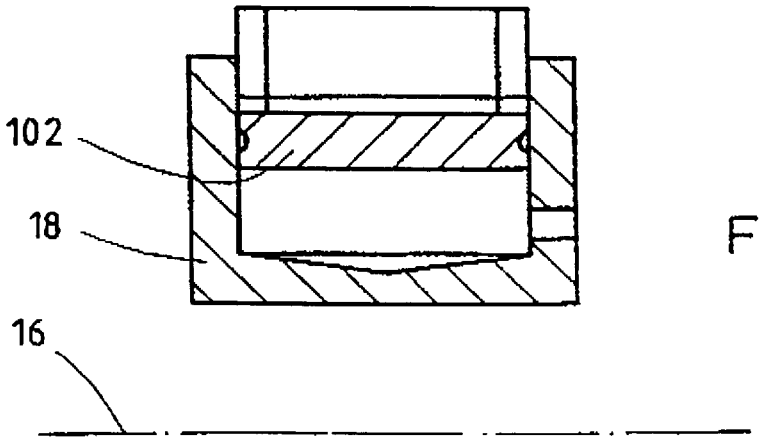
FIGS. 10*a* and 10*b* show modifications of the cylinder block in FIG. 3*a*.

In the preferred embodiment there is provided an antirotation device 50, which prevents turning of piston 44 in cylinder 36 and thus turning of roller 54 relative to curved path 12. Since the rollers are normally constantly in contact with the curved path, however, whereby the angular position of the roller and thus of the piston is automatically determined, it is not absolutely necessary to provide an antirotation device. This case is shown in FIG. 10*a*. Here the structure of the cylinder and piston is simplified substantially, since special manufacturing steps do not have to be performed either for piston 102 or for the cylinder block.

Figure 10B:
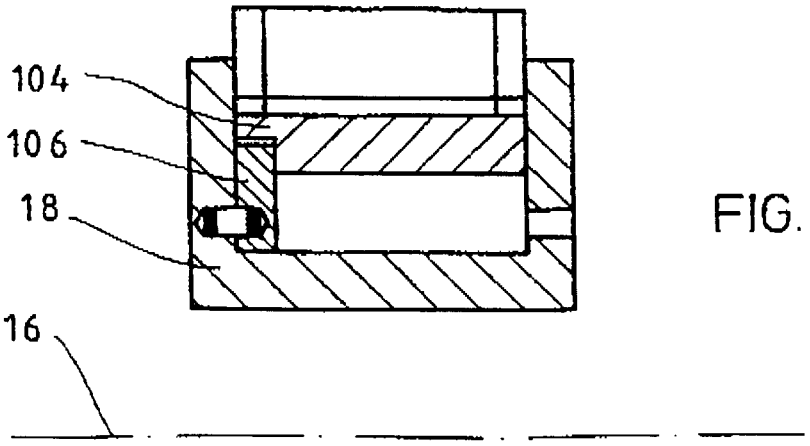

It is also possible by another relatively simple structural modification to the piston and cylinder block, however, as shown for example in FIG. 10*b*, to provide an antirotation device 106 for piston 104 without having to form the piston and cylinder as stepped structures.

At this juncture it should be pointed out that all features described hereinabove, especially in connection with the geometry of the roller guide, the connection between roller guides and rollers, and also the antirotation device for the pistons, can be combined with one another to the extent technically possible.

The present invention therefore creates a technically optimized radial piston engine with a cam ring and a cylinder block, which is disposed to rotate relative to the cam ring around an axis of rotation and which has a plurality of cylinders aligned in the radial direction of the cylinder block. In each cylinder there is disposed a piston which can be displaced in radial direction, and which is braced via a roller against the cam ring. The roller is mounted in a bearing provided on the piston such that it can rotate around an axis of rotation parallel to the axis of rotation of the cylinder block while being braced axially in the cylinder relative to its axis of rotation via roller guides disposed at its front sides. The inventive radial piston engine is characterized in particular in that the roller guides are rigidly connected with the respective roller with respect to sliding in piston displacement direction and accordingly are urged in piston displacement direction by the respective roller both during a load stroke and during an idle stroke of the piston, whereby the roller guides do not come into contact with the cam ring.

We claim:

1. A radial piston engine (2) with a cam ring (8), a cylinder block (18) disposed to rotate relative to the cam ring (8) around an axis of rotation (16), the said block having a plurality of cylinders (36) aligned in radial direction of the cylinder block (18), in each of which cylinders there is accommodated a slidable piston (44), which is braced via a roller (54, 96, 100) against the cam ring, wherein the roller is mounted on the piston to rotate around an axis of rotation (58) parallel to the axis of rotation (16) of the cylinder block (18) and, relative to its axis of rotation (58), is braced axially in the cylinder (36) via roller guides (60, 90, 92, 94, 98) disposed at its end faces, characterized in that the roller guides (60, 90, 92, 94, 98) are rigidly connected to the respective roller (54, 96, 100) with respect to sliding in piston displacement direction.

2. A radial piston engine according to claim 1, characterized in that the roller guides (60, 90, 92, 98) are provided on the side facing the end face of the roller (54, 100) with a projection (62, 99), which is insertable into a recess **(54*c*, 54*d*, 101)** formed on the end face of the roller.

3. A radial piston engine according to claim 1, characterized in that the roller guides (96) are provided on the side facing the end face of the roller (96) with a recess (95), into which a projection (97) formed on the end face of the roller is insertable.

4. A radial piston engine according to one of claims 1 to 3, characterized in that the roller guides (60, 90, 94, 98) have on the side facing away from the end face of the roller a cylindrical surface corresponding to the cylindrical inside surface.

5. A radial piston engine according to one of claims 1 to 3, characterized in that the roller guides (92) have on the side facing away from the end face of the roller a surface which is rotationally symmetric or has the form of a spherical segment relative to the axis of rotation (58) of the roller.

6. A radial piston engine according to claim 5, characterized in that the roller guides (92) are connected with the roller to rotate therewith in the direction of rotation of the roller.

7. A radial piston engine (2), especially according to one of the preceding claims, with a cam ring (8), a cylinder block (18) disposed to rotate relative to the cam ring around an axis of rotation (16), the said block having a plurality of cylinders (36) aligned in radial direction of the cylinder block, in each of which cylinders there is accommodated a slidable piston (44), which is braced via a roller (54, 96, 100) against the cam ring, wherein the roller is mounted on the piston to rotate around an axis of rotation (58) parallel to the axis of rotation (16) of the cylinder block (18) and, relative to its axis of rotation (58), is braced axially in the cylinder via roller guides (60, 90, 92, 94, 98) disposed at its end faces, characterized by an antirotation device (50), disposed separately from the roller guides, to prevent turning of the piston in the cylinder.

8. A radial piston engine according to claim 7, characterized in that the piston is provided on the end portion facing away from the roller with a flattened part, which bears on a corresponding contact face of the antirotation device.

9. A radial piston engine according to claim 8, characterized in that the cylinder is provided with at least two cylinder portions (38, 40) of different diameters and the piston is provided accordingly with at least two piston portions (46, 48) of different diameters matching the corresponding cylinder diameters, the antirotation device being provided in the cylinder portion (40) with the smaller inside diameter and the flattened part being provided on the piston portion (48) with the smaller diameter.

10. A radial piston engine according to claim 9, characterized in that the antirotation device has a cross section which, viewed in piston displacement direction, is a circular segment, with an arc corresponding to the cylindrical inside face and a chord corresponding to the flattened part.

11. A radial piston engine according to one of claims 7 to 10, characterized in that the antirotation device is fixed to the cylindrical inside face of the cylinder portion (40) with the smaller diameter by means of a pin (76), which is inserted via an inlet port (43) for supply and removal of hydraulic fluid in the cylinder space, the pin (76) being fastened in an opening (84) in the cylinder block (18) aligned with the inlet port (43).

* * * * *